United States Patent [19]

Hartl et al.

[11] Patent Number: 4,739,512

[45] Date of Patent: Apr. 19, 1988

[54] HEARING AID

[75] Inventors: Christof Hartl, Neunkirchen; Ulrich Birkholz, Nurenberg; Peter Nassler, Eckental; Hans-Joachim Weiss, Nurenberg, all of Fed. Rep. of Germany

[73] Assignee: Siemens Aktiengesellschaft, Berlin and Munich, Fed. Rep. of Germany

[21] Appl. No.: 875,929

[22] Filed: Jun. 19, 1986

[30] Foreign Application Priority Data

Jun. 27, 1985 [DE] Fed. Rep. of Germany ... 851868[U]

[51] Int. Cl.[4] ..... H04R 25/02

[52] U.S. Cl. ..... 381/68.6; 381/69

[58] Field of Search ..... 381/68, 68.6, 69

[56] References Cited

U.S. PATENT DOCUMENTS

| | | | |
|---|---|---|---|
| 3,047,089 | 7/1962 | Zwislocki | 181/23 |
| 3,513,269 | 5/1970 | Wilson | 381/68.6 |
| 3,852,540 | 12/1974 | Diethelm | 381/68.6 |
| 4,069,400 | 1/1978 | Johanson | 381/68.6 |
| 4,532,649 | 7/1985 | Bellafiore | 381/68.6 |
| 4,539,440 | 9/1985 | Sciarra | 381/68.6 |
| 4,565,904 | 1/1986 | Harada | 381/68.6 |
| 4,617,429 | 10/1986 | Bellafiore | 381/69 |

FOREIGN PATENT DOCUMENTS

| | | |
|---|---|---|
| 1274657 | 2/1966 | Fed. Rep. of Germany . |
| 1487272 | 3/1969 | Fed. Rep. of Germany . |
| 2949992 | 3/1980 | Fed. Rep. of Germany . |
| 648272 | 2/1985 | Switzerland . |
| 1117245 | 6/1968 | United Kingdom . |
| 1173657 | 12/1969 | United Kingdom . |
| 2070890 | 9/1981 | United Kingdom . |

*Primary Examiner*—Jin F. Ng
*Assistant Examiner*—L. C. Schroeder

[57] ABSTRACT

A hearing aid has a housing which includes electronic components such as a microphone, amplifier, power source and receiver, as well as suitable structure for mounting and retaining those components. The housing is inserted in a cavity in a shell. The exterior of the shell is matched to the shape of the auditory canal of the user. The cavity of the shell in which the housing is received tapers to a smallest diameter at a sound discharge end of the shell. The housing also has a smallest diameter at this location. A releasable latch is disposed in the region of the smallest diameter for holding said housing in place within the shell during use, but permitting removal of the housing for repair or replacement without damaging the shell.

19 Claims, 3 Drawing Sheets

HEARING AID

BACKGROUND OF THE INVENTION

1. Field of the Invention

The present invention relates to hearing aids, and in particular to a housing for a hearing aid having a shell with a component-containing housing received therein.

2. Related Application

Subject matter of the present application is related to the subject matter of copending U.S. application Ser. No. 807893, filed Dec. 11, 1985 (Nassler).

3. Description of the Prior Art

In hearing aid technology it is known to form a shell of moldable material to conform to the auditory canal of the hearing aid user sometimes referred to as an "ear mold". It is also known to insert a housing containing the electronic components of the hearing aid inside the shell. Such a hearing aid is known, for example, from Great Britain patent No. 2 070 890.

In hearing aids which are small enough so as to be substantially introduced into the auditory canal, facilitation of such insertion is aided as much by the structure of the hearing aid housing as by a space-saving arrangement of the integrated electronic components. As described in the aforementioned British patent, heretofore custom-made housings were formed for each patient, conforming to that patient's auditory canal, with the electronic components of the hearing aid then being built into the shell. This has the disadvantage, however, that a function test is only possible after the individual shell is ready and can be placed into the ear of the patient. The built-in components can be removed or dismantled for repair or replacement only by breaking open the housing, the housing usually being glued. Additionally, a canal for venting of the volume enclosed in the auditory canal by the device must be included during manufacture of the shell.

Such problems are also present in miniature hearing aids of the type, wherein the greater part of the housing is accomodated in the external ear, and only the receiver projecting from the hearing aid is introduced into the auditory canal. For devices having a relatively large cross-section at the outside surface thereof, one solution to the above problems is disclosed in German OS No. 14 87 272, wherein the individual elements of the hearing aid are accomodated in a housing which is inserted by means of a releasable latch into an intermediate housing. The exterior of the intermediate housing is adapted with the shell to the shape of the auditory canal of the user's ear.

SUMMARY OF THE INVENTION

It is an object of the present invention to provide a hearing aid which can be substantially introduced into the auditory canal, wherein a shell can be used to conform the hearing aid to the shape of the auditory canal, but the components within the hearing aid can be easily removed without damaging the shell.

The above object is inventively achieved in a hearing aid having a housing containing the electronic components thereof which is received into a cavity of the shell, wherein the respective diameters of the cavity and the housing continually decrease toward a sound discharge end (i.e., the portion of the hearing aid inserted farthest into the auditory canal), so that the cavity and housing having the shape of a funnel. The housing and the otoplastic shell are releasably latched together in the region of the smaller diameter. The hearing aid has the advantages deriving from the use of a two-piece housing, i.e., the electronic components can be removed for repair or replacement without damaging the shell, and has the further advantage that no significant additional space is required to hold the electronic components within the shell.

In accordance with the principles of the present invention, the hearing aid components accomodated within a housing can be mass produced and given the smallest possible dimensions. It is possible to use molded components having a minimum wall thickness for the housing, because the housing wall will be reinforced upon introduction into the shell. Adaptation to the naturally occurring cross-sections of the auditory canal is especially facilitated by giving the housing a cross-section which is generally kidney-shaped.

Incorporation of the component-containing housing into the shell can be promoted when the housing of the hearing aid is designed in two pieces, and all parts thereof except the receiver are received in one part of the housing, with the receiver being accomodated in the second part. Connection of the two parts of the housing can be rigid because the capability of introducing the housing into the shell is already favorable due to the shaping thereof. The connection of the housing portion containing the receiver to the housing portion which contains the remaining components of the hearing aid can, however, also be made movable. In general, it is adequate to arrange the earphone so as to be rotatable by approximately 300° C. around its longitudinal axis, because all positions and shapes which the auditory canal can assume can then be accomodated.

It is even more favorable, if, in addition to rotation of up to 300°, the point of connection between the housing parts can be made pivotable up to about 10°, (5° in opposite directions). With this embodiment, an even greater number of auditory canal shapes can be accomodated.

Locking of the housing containing the electronic components of the hearing aid to the shell (or to an intermediate housing therebetween) can be achieved by appropriately forming the surfaces which come into contact with each other, i.e., by making the adjoining surfaces stepped. This can be especially beneficial if the steps are located at positions accessible for later separation of the parts, so that the connection can be detached without destroying the housing. The arrangement of the steps is preferable, for example, at those regions of the housings having small diameters. During later completion of the hearing aid, these locations generally having relatively thin walls which are flexible, and are therefore favorable for snap-in connection. If an intermediate housing is used, the number of parts if further minimized.

In one embodiment, the housing containing the electronic components can be provided with a projection at the smallest diameter end thereof, the projection being exteriorly threaded. The threaded projection extends through the shell, and through the intermediate housing if an intermediate housing is used, and a nut is then threaded thereon to hold the component-containing housing in place with respect to the shell. Instead of threaded parts, the projection can be provided with an annular bead, with a ring holding the shell and the housing together being forced over the bead.

Another type of snap-in connection can be undertaken by complimentary steps formed on the exterior of the housing and the interior of the shell. The outside wall of the housing may have one or more steps increasing in the direction of larger diameters, with corresponding steps against which the housing steps are seated being provided in the interior of the shell or the intermediate housing, if one is used. For example, the terminating edge of the housing may engage such steps during insertion into the shell or intermediate housing. In order to improve this hold, the terminating edge of the housing can be provided with a reinforcement, such as a ring. This hold is releasable when the wall of the housing containing the components is made flexible at the location at which the catching step is dispose, by having a thin wall thickness at this location. This permits the remaining step to be pressed into a degree such that the adjacent catch edge can be slipped over it.

Plastics such as, for example, polyoxymethylene or cellulose acetate, which are standard and well known in the manufacture of hearing aids, are suitable as materials for the housing, the shell, and the intermediate housing. The wall thickness of the house is preferably between about 0.2 through about 0.5 mm. If a ring is inserted for reinforcing one of the catch edges, this ring can consist of a mechanically strong plastic such as polymethyl methacrylate. The shell which permits adaptation to the auditory canal of the user, and as a result achieves an improved retention in the ear, can be manufactured in a known manner. For this purpose, an impression of the auditory canal is taken and a casting is made from the impression. The otoplastic may be made, for example, by an appropriate coating on the intermediate housing. For this purpose, the intermediate housing is introduced, for example, into the mold produced from the impression, and a clearance between the intermediate housing and the edges of the mold is then filled with plastic material. A suitable shell is thus obtained after hardening. Instead of using the intermediate housing, an appropriately shaped die may also be inserted into the mold for producing the cavity in the shell, and can be removed after the plastic material has hardened.

A further embodiment of the hearing aid in accordance with the principles of the present invention has the advantage that a finished hearing aid is available for testing by itself before the shell is made. For testing the acoustical data of the hearing aid and for matching the hearng aid to the particular hearing impairment of the user, the hearing aid without the shell can be inserted in the user's ear with an acoustic seal, and any necessary adjustments can then be undertaken. For this purpose, a component which corresponds to the end section of the intermediate housing, and which permits latching to the hearing aid components, can be attached to the sound exit aperture of the component-containing housing. The end of this component which serves as an adapter can be provided with a projection onto which a so called adapter button (ear-tip) is plugged. This enables insertion of the device into the ear. By using various adapter buttons, the test adapter can be used for various shapes of the auditory canal. If the latching projection of the housing is threaded, the adapter may have a matching threaded portion for connection therewith, or, as described above, a ring which is forced over a bead on the housing projection may be used.

If the latching means for the housing and shell is an annular threaded nut or a ring, these components can be made in the form of a cap having a base or flat portion provided with holes. In addition to the latching function, this also provides protection for the sound discharge opening against penetration by dirt and cerumen without occupying additional space.

It is also possible to provide a channel to the exterior of the ear to permit venting by outside air of the volume enclosed within the user's ear between the inserted device and the tympanic membrane. An indentation in the intermediate housing can be provided in accordance with the principles of the present invention to form such a channel, sometimes referred to as venting. When joined to the component-containing housing, a channel which extends from the small diameter end to the large diameter end of the hearing aid remains unobstructed.

Cross-sectional space can be saved at the location of the exterior plate or cover of the hearing aid by using an internally disposed snap-in connection. This can be made so that disconnection of the cover can be undertaken by means of a tool, such as a screwdriver, which is introduced through an opening in the housing, for example, the opening which is already present for receiving the battery. Externally visible scratches, which are unavoidable due to the use of the tool, will thus occur at an unseen interior location in the housing.

DESCRIPTION OF THE PREFERRED EMBODIMENTS

Figure 1:
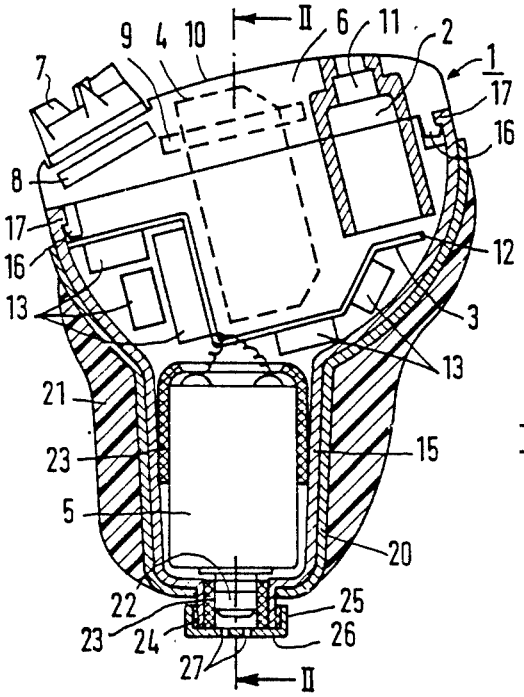
FIG. 1 is a sectional view of a hearing aid constructed in accordance with the principles of the present invention.

An embodiment of a hearing aid constructed in accordance with the principles of the present invention is generally referenced at 1 in FIG. 1. The hearing aid has, among other electronic components, a microphone 2, an amplifier 3, a battery 4 and a receiver 5 which are disposed within a housing 15. At the location of its largest diameter, the housing 15 is closed by a cover consisting of polyamide reinforced with glass fibers. The cover 6 has a volume control 7, a sound adjustment dial 8, and a mount 10 for the battery 4 which is pivotable around a shaft 9 connected within the cover 6. An opening 11 for admitting sound to the microphone 2 is also disposed in the cover 6. The electronic components of the amplifier, collectively referenced at 13, are mounted on a flexible carrier 12 inside the housing 15. The receiver 5 is connected to the amplifier. The cover 6 is connected to the housing 15 by hooks 16 which are received behind projections 17 of the housing 15. The hooks 16 and projections are arranged so that, proceeding through the opening of the mount 10, the connection between the cover 6 and the upper edge of the housing 15 can be reached with a tool, such as a screwdriver. The housing 15 can be opened by lifting the cover 6 with such a tool without visibly marking the outside of the cover 6.

Figure 5:
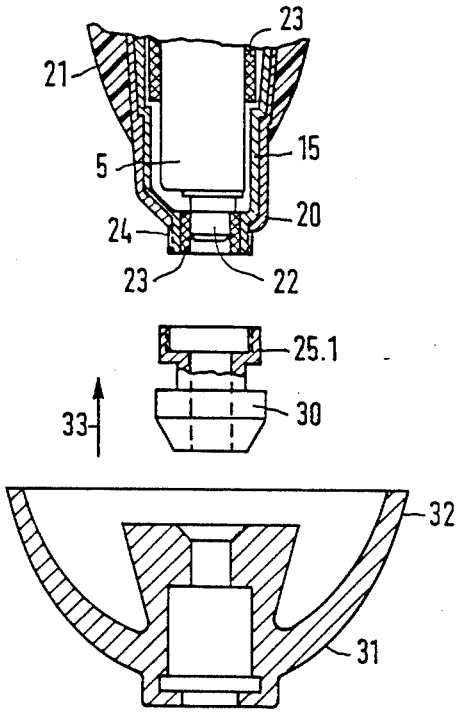
FIG. 5 is an exploded view of an adapter for testing the hearng aid of FIG. 1 without the shell thereon.

The housing 15 and components therein may be inserted in an intermediate housing 20, having an exterior wall to which an shell 21 is applied. At the end of the receiver 5 facing away from the amplifier 3, the receiver 5 has a sound exit cylinder 22 which, as the receiver 5 itself, is supported against the housing 15 by a cushion 23. A thread 24 is cut into the outside of the portion of the housing 15 disposed beyond the region of the cylinder 22. A threaded ring 25 having a base 26 with openings 27 therein is screwed onto the thread 24. For the purpose of testing the portion of the hearing aid within the housing 15 in the ear of a hearing-impaired person, before the shell is applied thereto, an adapter as shown in FIG. 5 can be used. The adapter has a screw ring 25.1 which can be screwed onto the thread 24, and has a plug 30 at its free end to which an adapter button 31 can be attached in the direction of the arrow 33. The adapter button 31 can consist of soft-elastic material and has a laterally protruding acoustically sealing bead 32, by means of which the auditory canal can be closed from the exterior.

Figure 2:
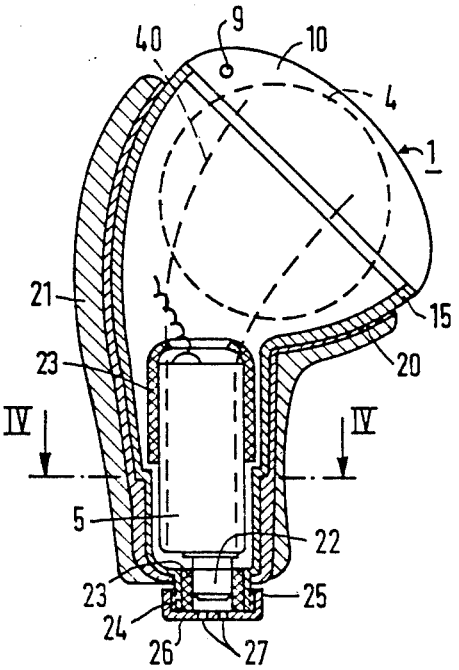
FIG. 2 is a sectional view taken along line II—II of FIG. 1.
Figure 3:
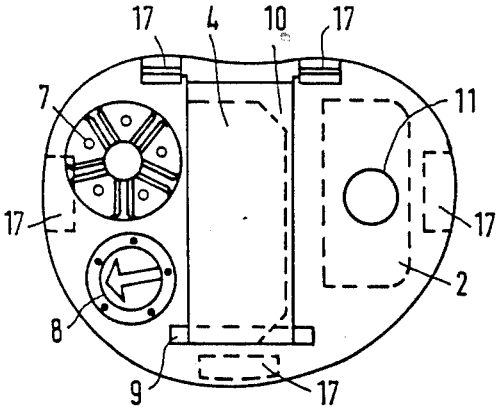
FIG. 3 is a plan view of the hearing aid of FIG. 1.
Figure 4:
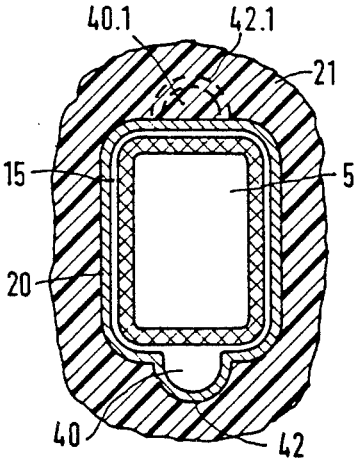
FIG. 4 is a sectional view taken along line IV—IV of FIG. 2.

A venting channel 40 is shown in FIG. 4 in a section taken along line IV—IV of FIG. 2, the channel 40 also being shown in broken lines in FIG. 2. The channel 40 leaves from that end of the housing 15 at which the sound exit cylinder 22 of the receiver 5 is disposed to that end of the intermediate housing 20 which is disposed at the opposite end of the housing, i.e., the end having the largest cross-section. The channel 40 is in the form of an indentation 42 of the intermediate housing 20, so that the channel remains open when the material comprising the otoplastic shell 21 is applied. An indentation 42.1 can be applied in addition to or instead of the channel 40 on the opposite side, the indentation 42.1 leading to a further venting channel 40.1.

In the embodiment shown in FIGS. 1 through 4, the housings 15 and 20, inserted into each other, are held together at their narrowest location, that is, the location of the smallest diameter, with the screw ring 25 so that they cannot become accidentially separated. Only after the ring 25 has been screwed off can the housing 15 be removed from the intermediate housing 20 and taken out for replacement or repair as needed.

Figure 6:
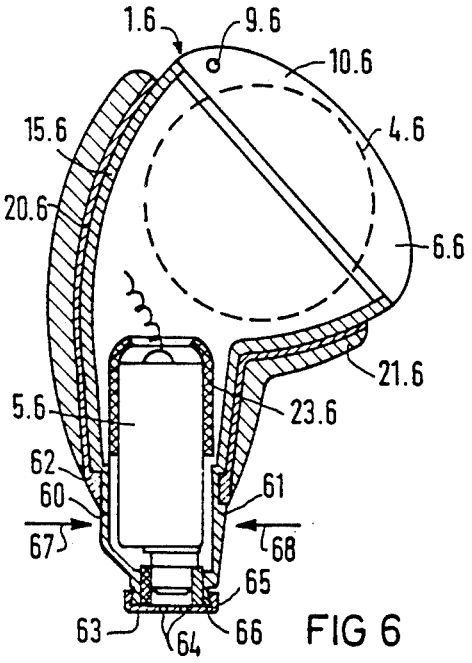
FIG. 6 is a further embodiment of the hearing aid of FIG. 1 using a snap connection between the component-containing housing an the intermediate housing.

The embodiment of the device 1.6 shown in FIG. 6 has a housing 15.6 retained in the intermediate housing 20.6 by lateral projections, two of which 60 and 61 are visible in FIG. 6. When the housing 15.6 is inserted into the intermidiate housing 20.6, the projecting such as 60 and 61 slide past the annularly constricted portion 62 of the intermediate housing 20, and snap toward the exterior as soon as they have moved beyond the construction 62, so that the device 1.6 is prevented from falling out of the intermediate housing 20.6. By pressing in the direction of the arrows 67 and 68, the projections such as 60 and 61 can be moved beyond the constriction 62, and the connection of the housing 15.6 to the intermediate housing 20.6 can be released.

As also shown in FIG. 6, the discharge opening of the hearing aid is closed with a cap 63, having apertures 64 therein for permitting the passage of sound therethrough. The cap 63 has lateral walls 65 which are drawn inwardly toward the open side of the cap 63 so as to engage behind a bead 66 which forms the distal end of the housing 15.6 at the sound exit side, and which holds the cap 63 in place.

The remaining elements shown in FIG. 6 are identical to those already described above and are therefore referenced identically. In FIG. 6, as in the following figures, only those components which have been modified are provided with a further reference symbol identifying the figure in which they appear.

Figure 7:
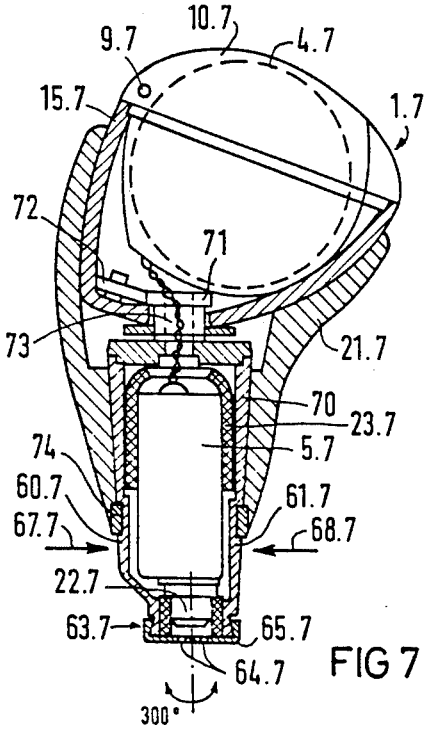
FIG. 7 is a sectional view of a further embodiment of a hearing aid of FIG. 1 having a two-piece housing with the two housing components being relatively movable.

In FIG. 7, all of the lectronic components witht he exception of the receiver 5.7 are disposed in one part 15.7 of the housing, whereas the receiver 5.7 is received in another part 70 of the housing. The housing part 70 is attached to the housing part 15.7 by a mount 71 which can be laterally pivoted by approximately 5° in opposite directions. The mount 71 can also be laterally pivoted by approximately 300° around the longitudinal axis of the receiver 5.7. A detent 72 is provided to limit the rotation so as to prevent tearing the connection lines 73. The constriction references at 62 in FIG. 6 is in the embodiment of FIG. 7 replaced by a ring 74 in the device 1.7. The ring 74 is inserted at the lower end of the shell 21.7, and it consists of polymethyl methacrylate so as to further strengthen this end for engagement with projections from the housing 70, two of which referenced at 60.7 and 61.7 are visible in FIG. 7. As in the embodiment of FIG. 6, the connection can be released by squeezing the projections 60.7 and 61.7 as indicated by arrows 67.7 and 68.7.

Figure 8:
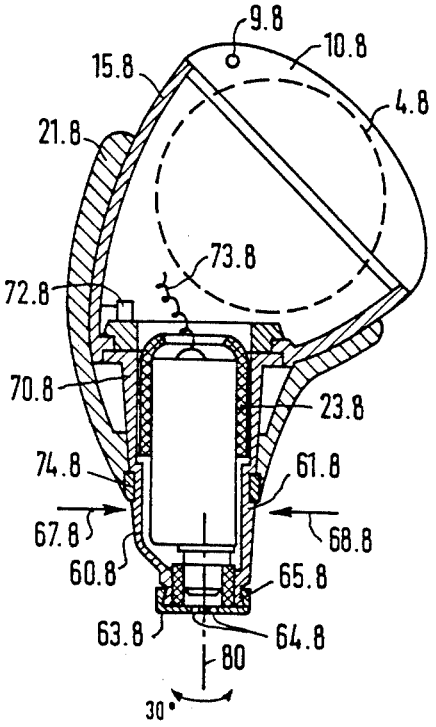
FIG. 8 is a section through the hearing aid of FIG. 7 for demonstrating rotatability of the earphone.

The embodiment of FIG. 8 is simplified in comparison to the embodiment of FIG. 7 in that the receiver in a housing 70.8 is pivotally held within the housing 15.8 so as to be movable toward either side by approximately 300° around its axis 80. Lateral rotation is limited by a detent 72.8 in order to avoid damage to the connections. Otherwise, the embodiment of FIG. 8 is the same as FIG. 7.

Figure 9:
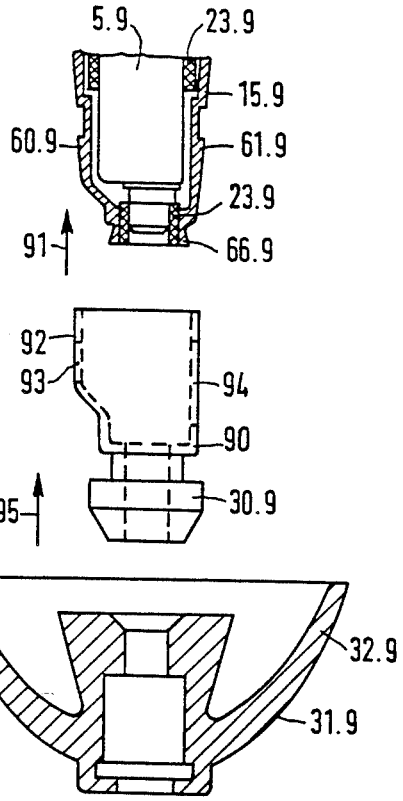
FIG. 9 is an exploded view of a further embodiment of an adapter for use in testing the hearing aid in the embodiments of FIGS. 6 through 8 without the shell thereon.

An adapter is shown in FIG. 9 corresponding to that shown in FIG. 5, but for use with the embodiments of FIGS. 6 through 8. Fastening of the device to the adapter shown in FIG. 9 is undertaken by a snap mechanism. For this purpose, the housing may be provided with projections 61.9 and 62.9 which engage behind an annular surface 92 as the adapter 90 is slipped onto the sound discharge end of the device in the direction of the arrow 91. The projections 61.9 and 62.9 are received in recesses 93 and 94 to secure the adapter 90 to the housing 15.9. The adapter button 30.9 with a sealing bead 32.9 can then be forced onto the plug 30.9 in the direction of the arrow 95.

Although modifications and changes may be suggested by those skilled in the art it is the intention of the inventors to embody within the patent warranted hereon all changes and modifications as reasonably and properly come within the scope of their contribution to the art.

We claim as our invention:

1. A hearing aid comprising:

a shell adapted for insertion in a user's auditory canal tapering to a smallest diameter at a sound discharge end, said shell having an interior cavity also tapering to a smallest diameter at said sound discharge end;

a housing containing a plurality of electronic components for receiving, amplifying and discharging sound, said housing having a shape adapted to be received in said cavity; and means disposed at said smallest diameter for releasably latching said housing in said cavity.

2. A hearing aid as claimed in claim 1, wherein said means for releasably latching comprises a plurality of projections disposed on an outside of said housing and a plurality of complementary recesses in an interior of said shell for engaging said projections for retaining said housing and said shell.

3. A hearing aid as claimed in claim 2, further comprising means for reinforcing said shell at said recesses.

4. A hearing aid as claimed in claim 3, wherein said means for reinforcing is a ring of mechanically resistant plastic disposed at said smallest diameter of said shell.

5. A hearing aid as claimed in claim 1, wherein said means for releasably latching comprises a cylindrical projection of said housing extending through said shell and having an exposed exterior portion, a ring surrounding said exposed portion, and cooperating means carried on said exposed portion and said ring for retaining said ring on said exposed portion.

6. A hearing aid as claimed in claim 5, wherein said cooperating means are mating threads carried on an exterior of said exposed portion and an interior of said ring.

7. A hearing aid as claimed in claim 5, wherein said cooperating means are an annular bead carried on an exterior of said exposed portion, said ring being forced over said bead and abutting thereagainst.

8. A hearing aid as claimed in claim 5, wherein said ring further has a cover attached thereto disposed over said sound discharge and when said ring is in place, said cover having a plurality of sound-admitting openings therein.

9. A hearing aid as claimed in claim 1, wherein said housing has a cover at a largest diameter and thereof opposite to said smallest diameter end, and a snap connection for retaining said cover on said housing.

10. A hearing aid as claimed in claim 9, wherein said cover has an opening therein disposed for providing access to said snap connection by a tool for releasing said snap connection without defacing an exterior of said cover.

11. A hearing aid as claimed in claim 1, wherein said plurality of electronic components includes a receiver, and wherein said housing consists of two parts, a first part receiving said receiver and a second part containing a remainder of plurality of electronic components, and means connecting said first and second housing parts permitting rotation and lateral pivoting of said parts with respect to each other.

12. A hearing aid as claimed in claim 1, further comprising an intermediate housing disposed in said cavity between said housing and said shell, said intermediate housing having an exterior wall to which said shell is attached.

13. A hearing aid as claimed in claim 12, wherein said means for releasably latching comprises a plurality of projections on an exterior of said housing at said smallest diameter end, and a plurality of complementary recesses in said intermediate housing for receiving said projections for holding said housing in said cavity.

14. A hearing aid as claimed in claim 1, wherein at least a portion of said housing has a kidney-shaped cross-section.

15. A hearing aid as claimed in claim 1, for use with an adapter for temporarily placing said hearing aid in a user's ear for testing, and wherein said means for releasably latching includes means for releasably connecting said housing to said adapter.

16. A hearing aid comprising:

a component-containing housing containing a plurality of electronic components for receiving, amplifying and discharging sound, including a receiver having a sound discharge cylinder, said housing tapering to a smallest diameter at a projection surrounding said sound discharge cylinder;

a shell adapted for insertion in a user's auditory canal formed on an intermediate housing adapted to receive said housing, said intermediate housing and said shell also tapering to respective smallest diameters and having respective openings in registry through which said projection of said housing extends; and means disposed at said smallest diameter cooperating with said projection for releasibly holding said housing in said intermediate housing and said shell.

17. A hearing aid as claimed in claim 16, wherein said means comprises a plurality of lateral projections carried on an exterior of said housing projection and a plurality of complementary recesses in an interior of said intermediate housing for receiving said lateral projections therein.

18. A hearing aid as claimed in claim 16, wherein said housing projection has an exposed portion extending beyond said intermediate housing and said shell, and wherein said means comprises a ring surrounding said exposed portion and means for retaining said ring on said exposed portion in abutment against said intermediate housing for holding said housing, said intermediate housing, and said shell together.

19. A hearing aid as claimed in claim 16, wherein said housing consists of a first portion in which said receiver is received, and a second portion in which a remainder of said plurality of electronic components are received, and means connecting said first and second housing portions permitting relative lateral and pivotal movement of said housing portions with respect to each other.

* * * * *